US008567925B2

(12) United States Patent
Yoshida et al.

(10) Patent No.: US 8,567,925 B2
(45) Date of Patent: Oct. 29, 2013

(54) INK-JET HEAD, INK-JET APPARATUS, AND METHOD OF MANUFACTURING THE SAME

(75) Inventors: Hidehiro Yoshida, Osaka (JP); Kazuki Fukada, Osaka (JP); Keisei Yamamuro, Osaka (JP)

(73) Assignee: Panasonic Corporation, Osaka (JP)

( * ) Notice: Subject to any disclaimer, the term of this patent is extended or adjusted under 35 U.S.C. 154(b) by 146 days.

(21) Appl. No.: 13/103,298

(22) Filed: May 9, 2011

(65) Prior Publication Data

US 2011/0279552 A1 Nov. 17, 2011

(30) Foreign Application Priority Data

May 12, 2010 (JP) ..... 2010-110254

(51) Int. Cl.
*B41J 2/045* (2006.01)
*B21D 53/76* (2006.01)

(52) U.S. Cl.
USPC ..... 347/70; 347/69; 29/890.1

(58) Field of Classification Search
USPC ..... 347/69
See application file for complete search history.

(56) References Cited

U.S. PATENT DOCUMENTS

| | | | | |
|---|---|---|---|---|
| 2001/0017502 | A1 | 8/2001 | Kappel et al. | |
| 2006/0214996 | A1 | 9/2006 | Matsuzaki et al. | |
| 2007/0296772 | A1 * | 12/2007 | Takahashi | 347/70 |

FOREIGN PATENT DOCUMENTS

| | | | |
|---|---|---|---|
| JP | 04-168049 | A | 6/1992 |
| JP | 08-085206 | A | 4/1996 |
| JP | 2000-082852 | A | 3/2000 |
| JP | 2006-297893 | A | 11/2006 |
| JP | 2008-087457 | A | 4/2008 |
| JP | 2008-254196 | A | 10/2008 |

OTHER PUBLICATIONS

Machine Translation of JP08085206, paragraphs 11 and 13.*

* cited by examiner

*Primary Examiner* — Lisa M Solomon
(74) *Attorney, Agent, or Firm* — Pearne & Gordon LLP

(57) ABSTRACT

The present invention provides an ink-jet head which comprises an ink supply channel configured to allow ink to flow, two or more ink chambers each having a bottom surface with a nozzle and an upper surface constituting of a vibrating plate, the two or more ink chambers being arranged in a row along a direction in which the ink flows in the ink supply channel, a partition wall partitioning the ink chambers. and a piezo-mounting plate having two or more multilayer piezoelectric elements and two or more columns fixed thereto. The two or more multilayer piezoelectric elements are arranged in a row, and the two or more columns are arranged between the multilayer piezoelectric elements. And also, the piezo-mounting plate is arranged on the upper surface of the ink chambers. In the ink-jet head, the vibrating plate constituting the upper surface of the ink chamber is held between the partition wall and the column. A large gap and a small gap are arranged between the two multilayer piezoelectric elements adjacent to each other, and the column is arranged at only the portion with a large gap.

7 Claims, 17 Drawing Sheets

INK-JET HEAD, INK-JET APPARATUS, AND METHOD OF MANUFACTURING THE SAME

CROSS REFERENCE TO RELATED APPLICATIONS

This application is entitled and claims the benefit of Japanese Patent Application No. 2010-110254, filed on May 12, 2010, the disclosure of which including the specification, drawings and abstract is incorporated herein by reference in its entirety.

TECHNICAL FIELD

The present invention relates to an ink-jet head, an ink-jet apparatus comprising the ink-jet head, and a method of the same.

BACKGROUND ART

The drop-on-demand ink-jet head is known as an ink-jet head that can eject a required amounts of ink droplets in response to the input signal, only when they are needed to print on the medium. In particular, extensive research is being undertaken on the piezoelectric (piezo) drop-on-demand ink-jet head as it is capable of well-controlled discharge of a wide variety of inks. The piezo drop-on-demand ink-jet head generally includes an ink supply channel; a plurality of ink chambers with a nozzle, which are connected to the ink supply channel; and piezoelectric elements for applying a pressure to the ink in the ink chambers.

In such a piezo drop-on-demand ink-jet head, piezoelectric elements deform to apply a pressure to the ink in the ink chamber in response to application of a drive voltage, so as to allow the ink to be discharged from nozzles. Broadly, there are three types of piezo drop-on-demand ink-jet head according to the manner in which the piezoelectric element deforms: shear mode, push mode and bend mode. In particular, because of its ability to produce high power at low voltage, the bend-mode piezo ink-jet head that uses multilayer piezoelectric elements is expected to be further developed for manufacturing of electric devices in which a highly viscous ink is printed, examples of the electric devices include an organic EL display panels and a liquid crystal panels.

FIG. 1 is a partially cross-sectional enlarged view of ink-jet head 10 disclosed in the Patent Literature 1. As illustrated in FIG. 1, ink-jet head 10 has an ink supply channel (not shown), a plurality of ink chambers 2*b* having nozzle 3*a*, and piezo-mounting plate 40 having multilayer piezoelectric elements 5*f* and columns 5*g* provided alternately.

Each ink chamber 2*b* is partitioned by partition walls 2*d*. Multilayer piezoelectric elements 5*f* vibrate vibrating plate (diaphragm) 6*a* constituting wall surfaces of ink chambers 2*b*. In ink-jet head 10, a plurality of ink chambers 2*b* shares the single diaphragm 6*a*. Diaphragm 6*a* is fixed by being held between columns 5*g* and partition walls 2*d*.

In the above ink-jet head 10, multilayer piezoelectric elements 5*f* vibrate diaphragm 6*a* constituting the wall surfaces of ink chambers 2*b*, whereby the ink in ink chamber 2*b* is pressurized to be ejected through nozzle 3*a*.

Further, in ink-jet head 10, diaphragm 6*a* is fixed by being held between columns 5*g* and partition walls 2*d*. Diaphragm 6*a* is fixed thus, whereby the vibration in ink chamber 2*b* is prevented from transmitting to the adjacent ink chamber 2*b* via diaphragm 6*a* (the transmitting of the vibration is a so-called "crosstalk").

The resolution of a printer with the above ink-jet head 10 is determined by a nozzle-to-nozzle pitch P1 (hereinafter also referred to simply as "a nozzle pitch"). Specifically, the longer the nozzle pitch P1, the lower the resolution, and the shorter the nozzle pitch P1, the higher the resolution.

Patent literatures other than the Patent Literature 1 also disclose the technique of fixing a diaphragm by holding the diaphragm between columns (dummy sections) and partition walls (for example, see Patent Literatures 2 and 3).

Further, there has been proposed an ink-jet head having hexagonal columnar piezoelectric elements (for example, see Patent Literature 4). In the ink-jet head described in the Patent Literature 4, a voltage is applied to both the hexagonal columnar piezoelectric elements and triangular prism shaped piezoelectric elements arranged between the hexagonal columnar piezoelectric elements. Furthermore, another technique of manufacturing hexagonal columnar piezoelectric elements has been proposed (for example, see Patent Literatures 5 and 6).

Furthermore, there has been known a hexagonal columnar multilayer piezoelectric element having a hollow space therein, the hollow space being for an ink chamber (for example, see Patent Literature 7).

Ink-jet heads sometimes encounter the problem of failing to accurately discharge ink droplets due to air inclusion or nozzle clogging. To overcome this drawback, there have been proposed techniques in which ink is allowed to circulate through the ink-jet head so as to prevent air inclusion and nozzle clogging, the circulating means ink-feeding into and ink discharging from ink chambers (see, e.g., Patent Literature 8).

CITATION LIST

Patent Literature

PTL 1: Japanese Patent Application Laid-Open No. 2008-087457

PTL 2: Japanese Patent Application Laid-Open No. 2006-297893

PTL 3: U.S. Patent Application No. 2006/0214996

PTL 4: Japanese Patent Application Laid-Open No. 04-168049

PTL 5: Japanese Patent Application Laid-Open No. 2000-082852

PTL 6: U.S. Patent Application No. 2001/0017502

PTL 7: Japanese Patent Application Laid-Open No. 8-085206

PTL 8: Japanese Patent Application Laid-Open No. 2008-254196

SUMMARY OF INVENTION

Technical Problem

Recently, for the sake of manufacturing an electronic device, such as an organic EL display and a liquid crystal panel, an ink-jet head having high resolution and a large ejection force is required to be developed.

In order to improve the resolution of the ink-jet head, a nozzle pitch is required to be shortened. For example, in ink-jet head 10 illustrated in FIG. 1, nozzle 3*a* is provided each ink chamber 2*b*. Thus, the nozzle pitch P1 is determined by the arrangement pitch of ink chambers 2*b*. Further, the arrangement pitch of ink chambers 2*b* is determined by an arrangement pitch P2 of piezoelectric elements 5*f*. Accordingly, in order to shorten the nozzle pitch P1, it is necessary to shorten the arrangement pitch P2 of multilayer piezoelectric elements 5*f* on piezo-mounting plate 40.

In ink-jet head 10 illustrated in FIG. 1, in order to shorten the arrangement pitch P2 of multilayer piezoelectric elements 5*f*, a gap between multilayer piezoelectric elements 5*f* may be narrowed. In order to narrow the gap between multilayer piezoelectric elements 5*f*, it may be considered to reduce a width D1 of multilayer piezoelectric element 5*f* or reduce a width D2 of column 5*g*.

However, when the width D1 of multilayer piezoelectric element 5*f* is reduced, the area of a moving surface of multilayer piezoelectric element 5*f* (surface pushing diaphragm 6*a*) is also reduced, so that the force of multilayer piezoelectric element 5*f* that vibrates diaphragm 6*a* is reduced. If the force of vibrating diaphragm 6*a* is reduced, ink in ink chamber 2*b* is not satisfactorily pressurized, so that the ejection force is reduced.

There is a process limitation of reducing the width D2 of column 5*g*, and therefore it is difficult to form column 5*g* with the width D2 of not more than 30 μm, for example.

Meanwhile, in order to enhance the ink ejection force of the ink-jet head, the area of the moving surface of the multilayer piezoelectric element is required to be increased. In ink-jet head 10 illustrated in FIG. 1, in order to increase the area of the moving surface of multilayer piezoelectric element 5*f*, it may be considered to increase the width D1 of multilayer piezoelectric element 5*f*. However, when the width D1 of multilayer piezoelectric element 5*f* is increased, the arrangement pitch P2 of multilayer piezoelectric elements 5*f* and the nozzle pitch P1 increase, so that the resolution of ink-jet head 10 is reduced.

Further, in ink-jet head 10, it may be considered that column 5*g* is omitted so as to reduce the arrangement pitch P2 of multilayer piezoelectric elements 5*f* or to increase the width Dl of multilayer piezoelectric element 5*f*, whereby the area of the moving surface is increased. However, if the column for fixing diaphragm 6*a* is omitted, the vibration of ink chamber 2*b* transmits to the adjacent ink chamber 2*b* through diaphragm 6*a*, so that the crosstalk occurs. When the crosstalk occurs, it results in variations in the amount of ejected ink or the ejection pitch of the ink among ink chambers. Thus, the omission of column 5*g* is not realistic.

As discussed above, the conventional ink-jet heads cannot simultaneously realize "short pitch of the multilayer piezoelectric elements to obtain high resolution" and "increased area of the moving surface of the multilayer piezoelectric element to obtain high ejection force."

An object of the present invention is to provide an ink-jet head which can simultaneously realize "short pitch of the multilayer piezoelectric elements" and "increased area of the moving surface of the multilayer piezoelectric element."

Solution to Problem

A first aspect of the invention relates to the following ink-jet head.

[1] An ink-jet head including:

an ink supply channel configured to allow ink supplied from outside to flow;

two or more ink chambers each having a bottom surface with a nozzle for ejecting the ink and an upper surface constituted of a vibrating plate, the two or more ink chambers being arranged in a row along a direction in which the ink flows in the ink supply channel;

one or more partition walls each partitioning the ink chambers; and a piezo-mounting plate arranged on the upper surface of the ink chambers, the piezo-mounting plate having two or more multilayer piezoelectric elements and two or more columns fixed thereto, the two or more multilayer piezoelectric elements being arranged in a row, and the two or more columns being arranged between the multilayer piezoelectric elements, the two or more multilayer piezoelectric elements can vibrate the respective upper surfaces of the two or more ink chambers, wherein the vibrating plate constituting the upper surface of the ink chamber is held between each of the partition walls and each of the columns, a large gap and a small gap are arranged between the two multilayer piezoelectric elements adjacent to each other, and each of the columns is arranged at only the large gap.

[2] The ink-jet head according to [1], wherein the maximum value of a gap between the multilayer piezoelectric elements is 50 to 140 μm.

[3] The ink-jet head according to [1] or [2], wherein each of the multilayer piezoelectric elements has a hexagonal columnar shape, a bottom surface of each of the multilayer piezoelectric elements having the hexagonal columnar shape has sides a and b facing each other and being parallel to a direction in which the multilayer piezoelectric elements are aligned, the side a of each of the multilayer piezoelectric elements is aligned along a straight line, and the side b of each of the multilayer piezoelectric elements is aligned along a straight line.

[4] The ink-jet head according to [3], wherein the upper surface and the bottom surface of each of the ink chambers have a hexagonal shape.

[5] The ink-jet head according to any one of [1] to [4], further including an ink discharge channel communicating with the two or more ink chambers, and the ink discharge channel being configured to allow the ink discharged from the ink chamber to flow.

A second aspect of the invention relates to the following ink-jet apparatus.

[6] The ink-jet apparatus including the ink-jet head according to any one of [1] to [5].

A third aspect of the invention relates to the following method of manufacturing an ink-jet head.

[7] A method of manufacturing the ink-jet head according to any one of [1] to [5] including providing the piezo-mounting plate having the multilayer piezoelectric elements and the columns fixed, stacking the vibrating plate on the multilayer piezoelectric elements and the columns, and stacking the partition walls and a nozzle plate on the vibrating plate, wherein:

the step of providing the piezo-mounting plate comprises the steps of:

providing the piezo-mounting plate;

stacking a piezoelectric sheet and an electroconductive sheet on the piezo-mounting plate to form a laminate having a rectangular solid shape;

providing two or more grooves A in the laminate at a constant pitch, the two or more grooves A being inclined to the long side of a bottom surface of the laminate having the rectangular solid shape; and providing two or more grooves B in the laminate at a constant pitch, the two or more grooves B being inclined in the opposite direction to the grooves A with respect to the long side of the bottom surface of the laminate having the rectangular solid shape and intersecting with the grooves A, to form the multilayer piezoelectric elements and the columns.

Advantageous Effects of Invention

According to the present invention, the area of a moving surface of a multilayer piezoelectric element can be increased while securing an arrangement pitch of the multilayer piezoelectric elements, and the arrangement pitch of the multilayer piezoelectric elements can be shortened while securing the area of the moving surface of the multilayer piezoelectric element. Thus, the present invention provides an ink-jet head achieving high resolution and a large ejection force.

DESCRIPTION OF EMBODIMENTS

1. Ink-jet Head

Figure 1:
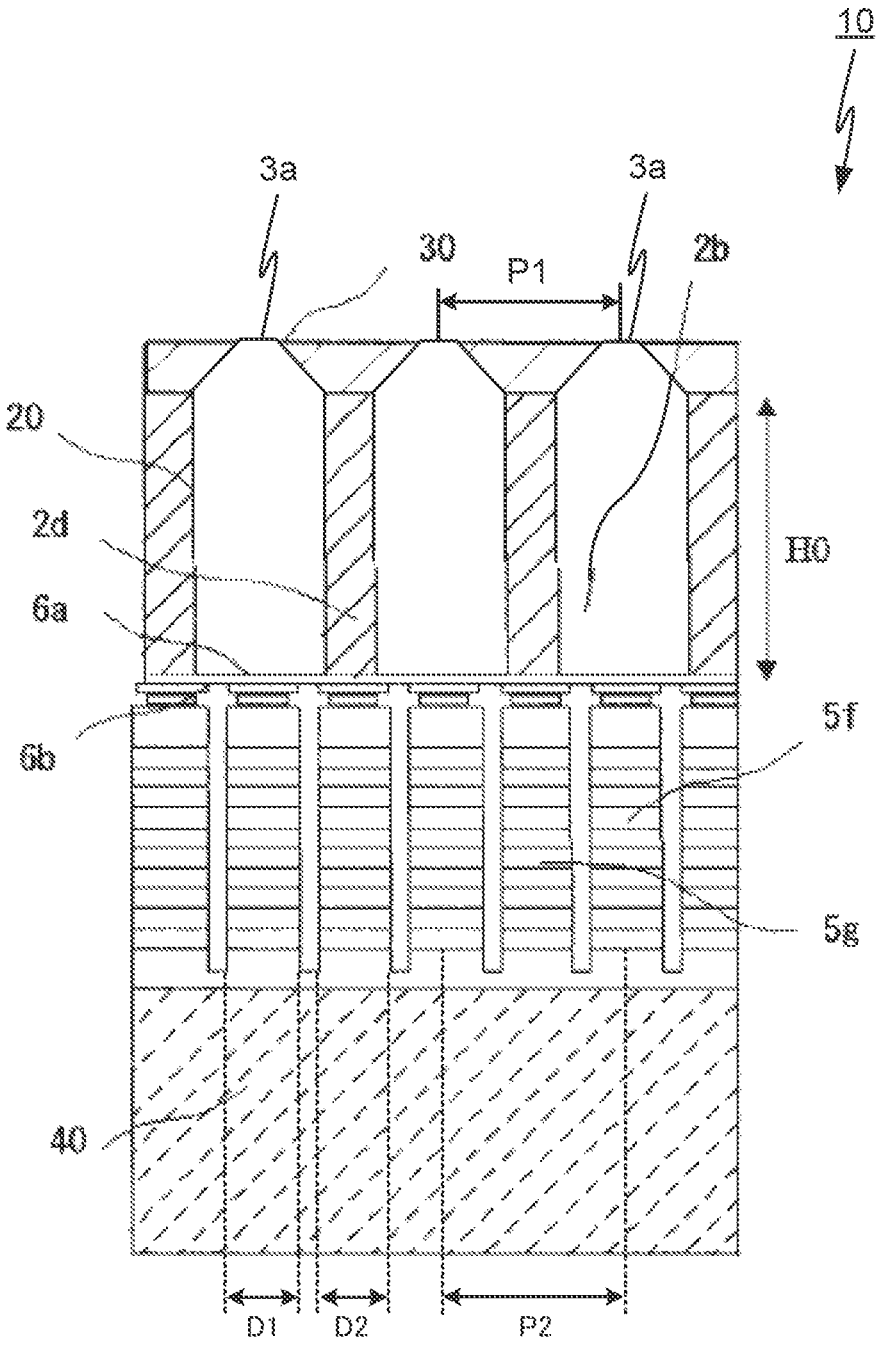
FIG. 1 is a cross-sectional view of a conventional ink-jet head.

The ink-jet head of the present invention is a bend-mode ink-jet head comprising multilayer piezoelectric elements. The ink-jet head of the present invention includes 1) an ink supply channel, 2) a plurality of ink chambers communicating with the ink supply channel, 3) a partition wall partitioning the ink chamber, and 4) a piezo-mounting plate disposed on the upper surface of the ink chamber, the plate having a plurality of multilayer piezoelectric elements and a plurality of columns fixed thereto.

A feature of the present invention lies in the devised structure and arrangement of the multilayer piezoelectric elements and the columns fixed to the piezo-mounting plate, whereby "short pitch of the multilayer piezoelectric elements" and "increased area of a moving surface of the multilayer piezoelectric element" are achieved simultaneously. Hereinafter, the above components will be described.

1) Ink Supply Channel

Ink supplied from outside flows through the ink supply channel. The ink flowing through the ink supply channel is supplied into ink chambers. The ink supply channel includes a feed port through which the ink is supplied from outside. There are no particular limitations on the flow rate of ink to be supplied to the ink supply channel; ink flow rate may be equal to or greater than several ml/min.

2) Ink Chamber

The ink chamber communicates with the ink supply channel, and is a space for storing ink to be ejected. There are no particular limitations on the type of ink to be stored in the ink chamber; ink type depends on the product to be manufactured. For example, when using the ink-jet head for the manufacturing of an organic EL display panel, the ink to be stored in the ink chamber may be a high viscosity solution containing luminescent material such as organic luminescent substance.

The ink-jet head of the present invention includes a plurality of the ink chambers. The ink chambers are arranged in a row along a direction in which the ink flows in the ink supply channel (hereinafter also referred to simply as an "ink flow direction") (see, FIG. 5).

Generally, up to 1024 ink chambers communicate with a single ink supply channel and a single ink discharge channel. All the ink chambers of the ink-jet head of the present invention usually have the same volume.

Each ink chamber has a bottom surface provided with a nozzle and an elastic upper surface. More specifically, the bottom surface of each ink chamber constitutes a nozzle plate, and the upper surface of each ink chamber constitutes a vibrating plate (hereinafter also referred to as a "diaphragm"). In the present invention, a plurality of ink chambers shares the single nozzle plate and the single vibrating plate (see, FIG. 6A). The side surface of the ink chamber constitutes a partition wall to be described later.

The upper and bottom surfaces of each ink chamber preferably have a hexagonal shape coinciding with the shape of hexagonal columnar multilayer piezoelectric element to be described later (see, FIG. 6C).

The nozzle is an ejection hole for ejecting ink from the ink chamber. The ink-jet head usually has one nozzle to one ink chamber. The ink in the ink chamber is ejected outside through the nozzle. The diameter of the nozzle is not limited particularly, and it may be approximately 10 to 100 μm.

The diaphragm is a vibratable member such as a metal film and a resin film. The amount of amplitude of the diaphragm is preferably set to not more than about 100 nm. This is because the amount of displacement of the multilayer piezoelectric element to be described later is approximately up to 200 to 300 nm.

In the diaphragm, it is preferable that a product EI between a Young's modulus E and a cross section two-dimensional moment I is set within the range of from $2.9\times10^{-19}$ GPa·m$^4$ to $6.2\times10^{-15}$ GPa·m$^4$. The Young's modulus E is a substancespecific constant. The cross section two-dimensional moment I is calculated by $I=b\times h^3/12$ (b: width of film, h: thickness of film).

Examples of the metal film constituting the diaphragm include a nickel film having thickness of 4 to 6 μm and a stainless steel film having Young's modulus E=190 to 220 GPa. The thickness of the stainless steel film may be selected so that the value of the cross section two-dimensional moment is $1.5\times10^{-20}$ to $2.8\times10^{-16}$ $m^4$. When the width of the stainless steel film is about 1 mm, the thickness of the stainless steel film may be 1 to 25 μm, and, for example, 20 μm.

The resin film constituting the diaphragm is required to have a high chemical resistance, and examples of the resin film include a film made of polyimide (Young's modulus E=3 to 5 GPa) and a film made of poly aryl ether ketone, but it is not limited particularly.

The diaphragm is fixed by being held between the partition walls and the columns to be described later.

3) Partition Wall

The partition wall is a member which partitions the ink chambers, and constitutes the side surface of the ink chamber. The partition wall may be produced by laminating a plurality of stainless steel (for example, SUS304 stainless steel) plates by thermal diffusion bonding, for example. The partition wall is bonded to both of the upper surface and bottom surface of the ink chamber.

4) Piezo-mounting Plate

The piezo-mounting plate is a plate to which a plurality of piezoelectric elements and a plurality of columns are fixed. The material of the piezo-mounting plate is ceramics, for example. By employing ceramics as piezo-mounting plate material, the thermal expansion coefficient of the piezoelectric element can be made equal to that of the piezo-mounting plate.

The piezoelectric elements arranged in a row along the ink flow direction and the columns arranged between the piezoelectric elements are fixed to the piezo-mounting plate. The piezoelectric elements and the columns are spaced apart from each other.

The piezoelectric elements vibrate the vibrating plate constituting the upper surface of the ink chamber, in response to a control signal. The piezoelectric element employed in the present invention is preferably an expandable multilayer piezoelectric element (hereinafter also referred to simply as a "multilayer piezoelectric element"). Multilayer piezoelectric element responds slowly to input, but produces large output force. The height of the multilayer piezoelectric element in a non-driving state (the length in the stacking direction) is usually 100 to 1000 μm.

The multilayer piezoelectric element has a fixing surface fixed to the piezo-mounting plate and a moving surface which contacts with the diaphragm constituting the upper surface of the ink chamber. It is preferable that the respective multilayer piezoelectric elements have the same size. By applying a drive voltage to the multilayer piezoelectric element, the moving surface of the multilayer piezoelectric element vibrates the upper surface of the ink chamber, and the ink in the ink chamber is pressurized. Consequently, the ink is ejected through the nozzle.

The column is a member for fixing the diaphragm. Specifically, the diaphragm is fixed by being held between the columns and the partition walls (see, FIG. 6A). By this constitution, the vibration of one ink chamber is prevented from transmitting to an adjacent ink chamber via the diaphragm (crosstalk). Although the shape of the column is not limited particularly as long as it can fix the diaphragm, it is a triangular prism shape, for example (see, FIGS. 2 and 7). The height of the column is usually the same as the height of the multilayer piezoelectric element, and it is 100 to 1000 μm.

As described above, the ink-jet head of the present invention has a feature in the structure and arrangement of the multilayer piezoelectric elements and the columns. More specifically, in the present invention, both of a large gap and small gap are arranged between the adjacent multilayer piezoelectric elements. The maximum value of a gap between the multilayer piezoelectric elements is 50 to 140 μm, and the minimum value thereof is 20 to 50 μm (see, FIG. 7B). Although the means for arranging both of a large gap and a small gap between the adjacent multilayer piezoelectric elements is not limited particularly, and for example they are realized by making the shape of the multilayer piezoelectric element a hexagonal columnar shape (to be described later).

Further, the present invention is characterized in that the column is arranged at the large gap, and is not arranged at the small gap between the adjacent multilayer piezoelectric elements.

As described above, a region where the column is not arranged is provided between the adjacent multilayer piezoelectric elements, whereby the area of the gap between the multilayer piezoelectric elements can be reduced. Consequently, "short pitch of the multilayer piezoelectric elements" and "increased area of a moving surface of the multilayer piezoelectric element" can be realized simultaneously.

Hereinafter, it will be explained reason that the effects of the present invention is achieved through arranging a region where the column is not arranged at the gap between the adjacent multilayer piezoelectric elements, with reference to the drawings. The effect of the present invention is simultaneously realizing "short pitch of the multilayer piezoelectric elements" and "increased area of the moving surface of the multilayer piezoelectric element."

Figure 2A:
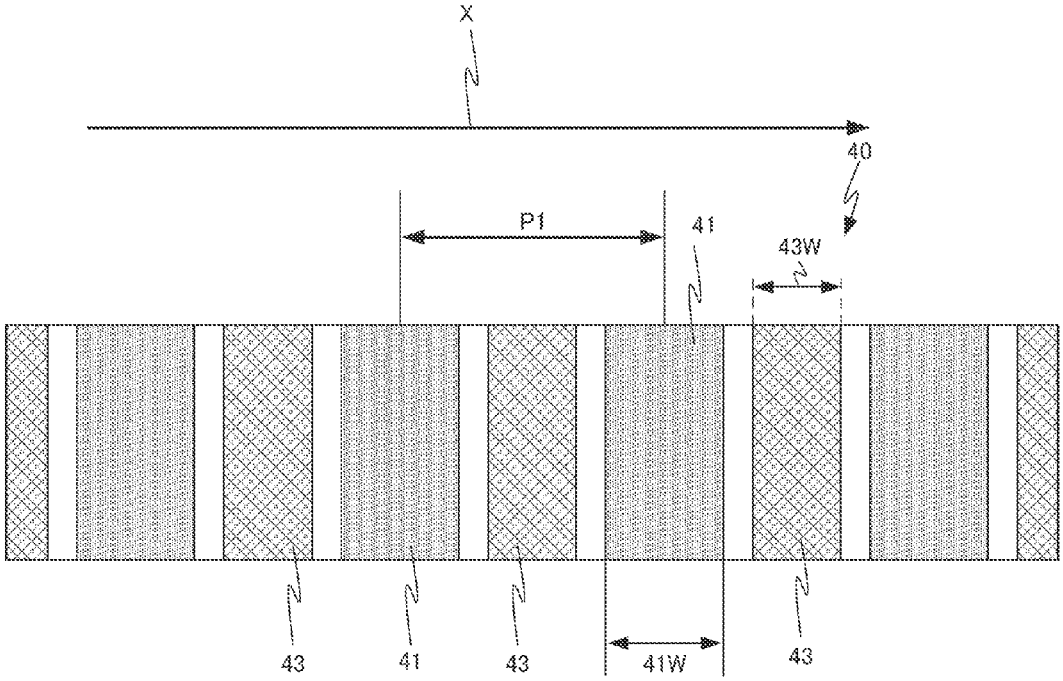
FIG. 2A is a plan view of a conventional piezo-mounting plate to which multilayer piezoelectric elements and columns are fixed as viewed from a moving surface side of the multilayer piezoelectric element.

FIG. 2A is a plan view of a conventional piezo-mounting plate 40 to which multilayer piezoelectric elements 41 and columns 43 are fixed as viewed from a moving surface side of multilayer piezoelectric element 41. As illustrated in FIG. 2A, in the conventional piezo-mounting plate 40, multilayer piezoelectric elements 41 arranged in a row in direction X at a constant pitch (P1) and columns 43 arranged between multilayer piezoelectric elements 41 are fixed. As shown in FIG. 2A, each column 43 covers the gap between multilayer piezoelectric elements 41.

In piezo-mounting plate 40 illustrated in FIG. 2A, it may be considered to reduce a width 43W of column 43 in order to shorten the arrangement pitch P1 of multilayer piezoelectric elements 41 or increase the area of the moving surface of multilayer piezoelectric element 41. However, there is a process limitation for reducing width 43W of column 43, and thus it is difficult to reduce the width 43W of column 43 to not more than 30 μm.

In addition to reducing the width 43W of column 43 up to the process limitation, in order to further shorten the arrangement pitch P1 of multilayer piezoelectric elements 41, width 41W of multilayer piezoelectric element 41 must be reduced. When the width 41W of multilayer piezoelectric element 41 is reduced, the area of the moving surface of multilayer piezoelectric element 41 is reduced, so that the ejection force of the ink-jet head is reduced.

And also in addition to reducing the width 43W up to the process limitation, in order to further increase the area of the moving surface of multilayer piezoelectric element 41, the width 41W of multilayer piezoelectric element 41 must be increased. When the width 41W of multilayer piezoelectric element 41 is increased, the arrangement pitch P1 of multilayer piezoelectric elements 41 is lengthened, so that the resolution of the ink-jet head is reduced.

Figure 2B:
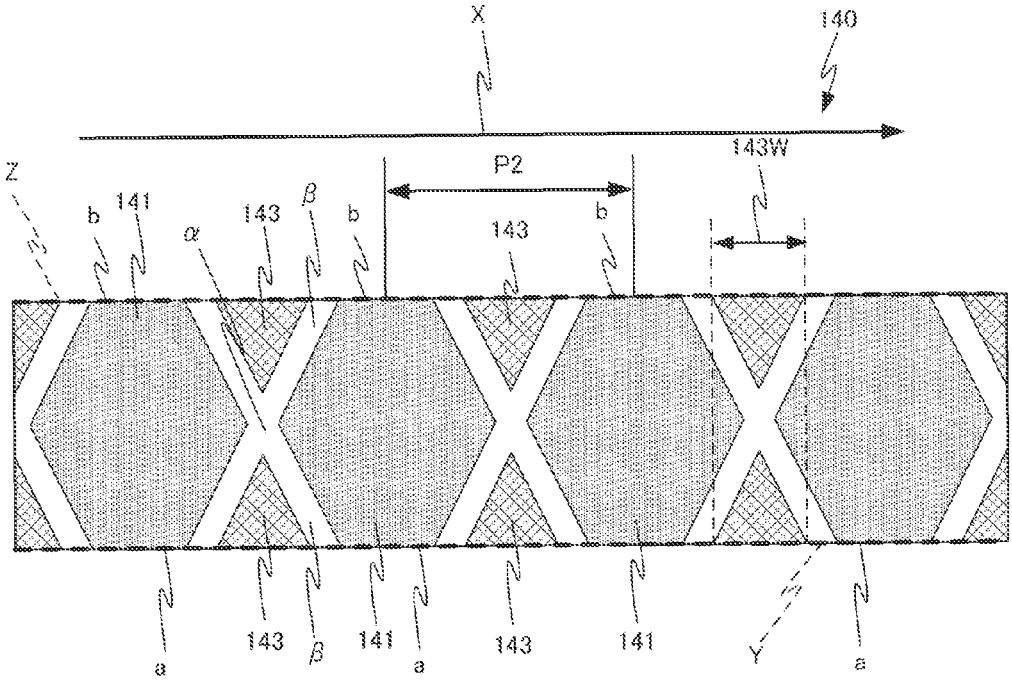
FIG. 2B is a plan view of a piezo-mounting plate of the present invention as viewed from the moving surface side of a multilayer piezoelectric element.

FIG. 2B is a plan view of piezo-mounting plate 140 employing the present invention as viewed from the moving surface side of the multilayer piezoelectric element. As illustrated in FIG. 2B, hexagonal columnar multilayer piezoelectric elements 141 arranged in a row along direction X at a constant pitch (P2) and triangular prism shaped columns 143 arranged between multilayer piezoelectric elements 141 are fixed to piezo-mounting plate 140.

The bottom surfaces (fixed surfaces to piezo-mounting plate) of hexagonal columnar multilayer piezoelectric elements 141 each have side a and side b facing each other and being parallel to direction X in which multilayer piezoelectric elements 141 are aligned (hereinafter also referred to simply as an "alignment direction"). The sides a of multilayer piezoelectric elements 141 are aligned along a straight line Y, and the sides b of multilayer piezoelectric elements 141 are aligned along a straight line Z. Both of sides a and sides b of the multilayer piezoelectric elements are aligned along a straight line respectively, as described above, whereby a portion β with a large gap and a portion α with a small gap can be arranged between the adjacent multilayer piezoelectric elements.

Column 143 is arranged at only the portion β with a large gap and is not arranged at the portion α with a small gap.

As illustrated in FIG. 2B, in the present invention, a region where the column is not arranged (the portion α with a small gap) is provided between the adjacent multilayer piezoelectric elements. Accordingly, if the width 143W of column 143 is reduced to the process limitation (30 μm), the horizontal projection area of column 143 is smaller than that of the conventional column 43 illustrated in FIG. 2A. Thus, in the present invention, the horizontal projection area of column 143 is reduced, so that the area of the gap between multilayer piezoelectric elements 141 can be reduced. By this constitution, the pitch P2 can be further shortened, or the area of the moving surface of multilayer piezoelectric element 141 can be further increased. Specifically, in the present invention, the pitch P2 can be shortened to 165 μm or less, and the resolution of the ink-jet head can be increased to 150 dpi or more. Further, in the present invention, the area of the moving surface of multilayer piezoelectric element 141 can be increased to 50000 $\mu m^2$ to 80000 $\mu m^2$.

As described above, in the present invention, the arrangement pitch of the multilayer piezoelectric elements can be shortened while securing the area of the moving surface of the multilayer piezoelectric element, and the area of the moving surface of the multilayer piezoelectric element can be increased while securing the arrangement pitch of the multilayer piezoelectric elements. Thus, according to the present invention, both of "short pitch of the multilayer piezoelectric elements" and "increased area of the moving surface of the multilayer piezoelectric element" can be realized simultaneously, and the ink-jet head of the present invention can achieve high resolution and large ejection force.

Figure 8:
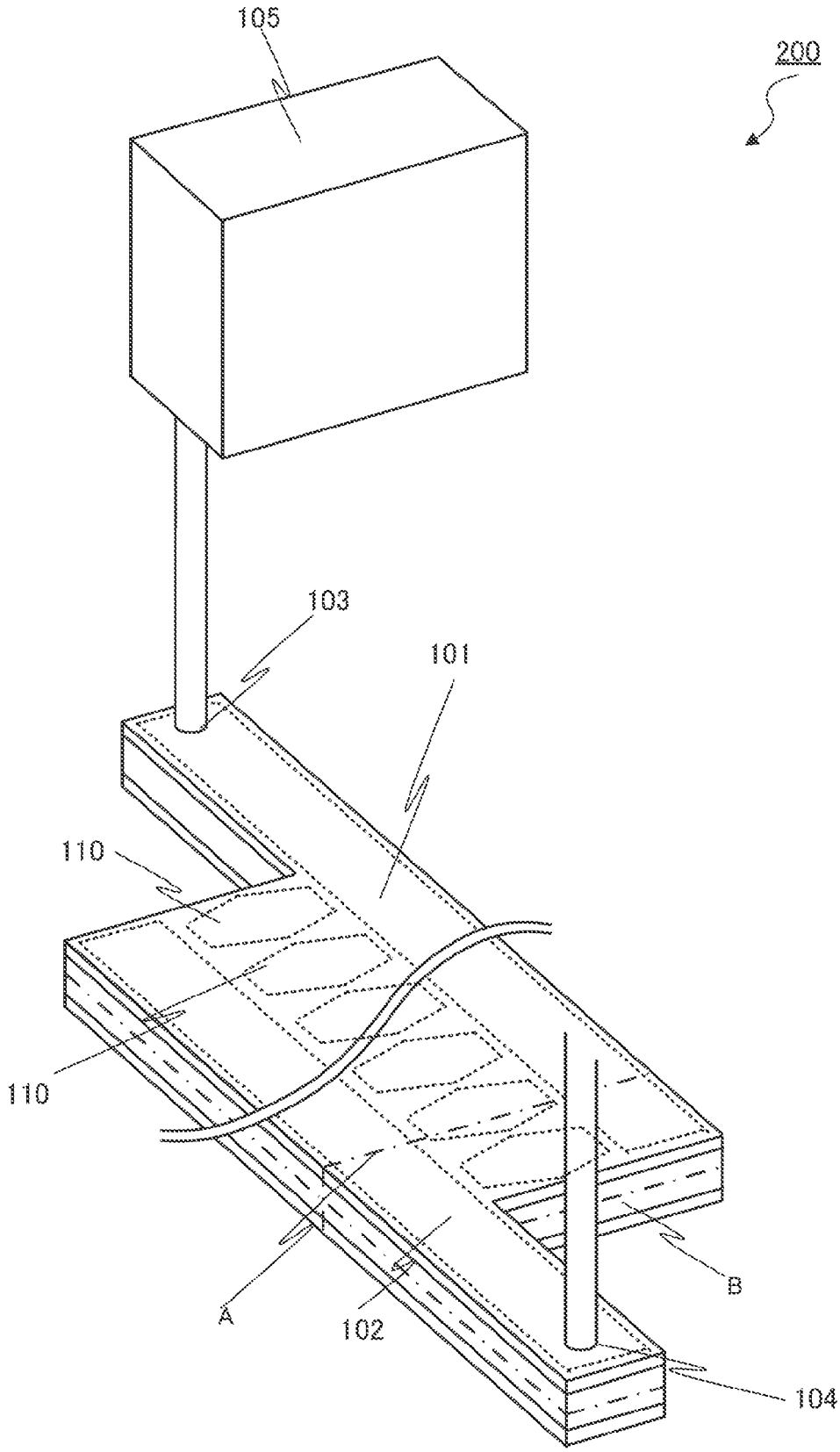
FIG. 8 is a perspective view of an ink-jet head of Embodiment 2.

The ink-jet head of the present invention may have an ink discharge channel (see, FIG. 8). The ink discharge channel is a passage configured to allow ink discharged from the ink chambers to flow, the ink discharge channel being parallel to the ink flow direction. The ink discharge channel includes a discharge port for discharging the ink to the outside. The ink discharge channel communicates with the ink chamber. By virtue of the provision of the ink discharge channel, new ink can always be supplied into the ink chamber from outside, so that mixture of air and ejection failure due to ink stagnation can be prevented.

2. Method of Manufacturing Ink-jet Head

The ink-jet head of the present invention is manufactured by any method as long as the effects of the present invention are not deteriorated. Preferred example of the method of manufacturing the ink-jet head of the present invention includes 1) a first step of providing the piezo-mounting plate to which the multilayer piezoelectric elements and the columns are fixed, 2) a second step of stacking the diaphragm on the multilayer piezoelectric elements and the columns fixed to the piezo-mounting plate, and 3) a third step of stacking the partition walls and the nozzle plate on the diaphragm.

1) In the first step, the piezo-mounting plate to which the multilayer piezoelectric elements and the columns are fixed is provided. A preferred manufacturing method of the present invention has a feature in the step of providing the piezo-mounting plate to which the multilayer piezoelectric elements and the columns are fixed. Hereinafter, the method of providing the piezo-mounting plate to which the multilayer piezoelectric elements and the columns are fixed will be described with reference to the drawings.

Figure 3A:
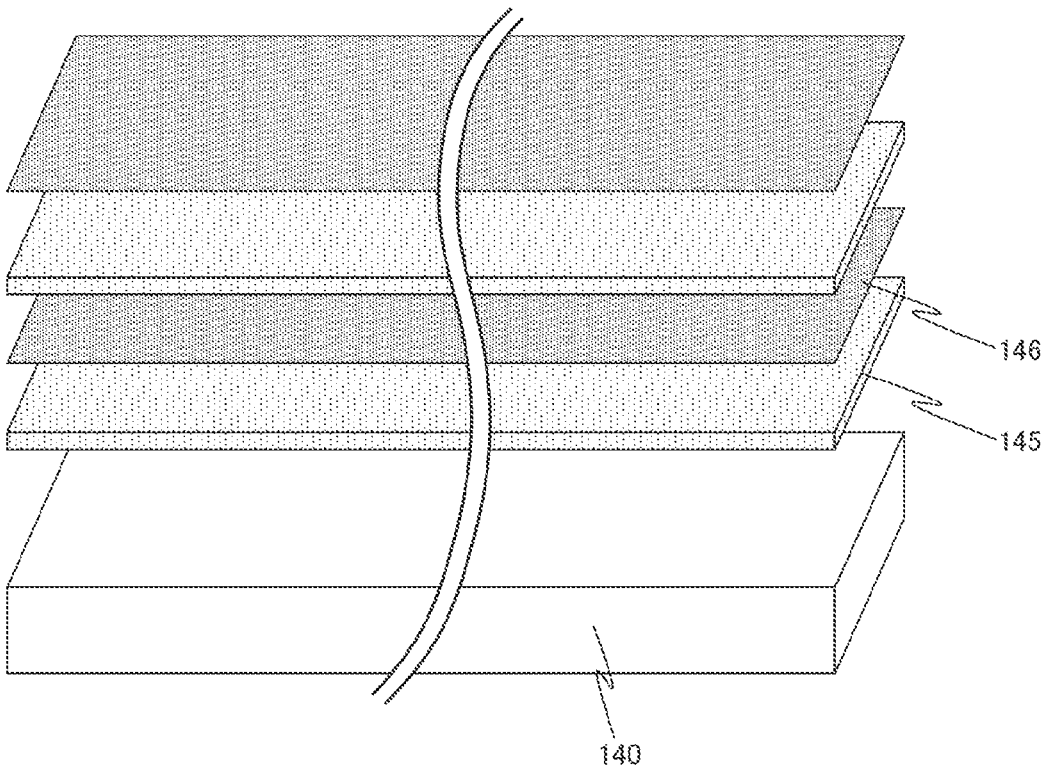
FIG. 3A is a perspective view showing an intermediate state of stacking a plurality of piezoelectric sheets and a plurality of electroconductive sheets on the piezo-mounting plate to produce a laminate.
Figure 3B:
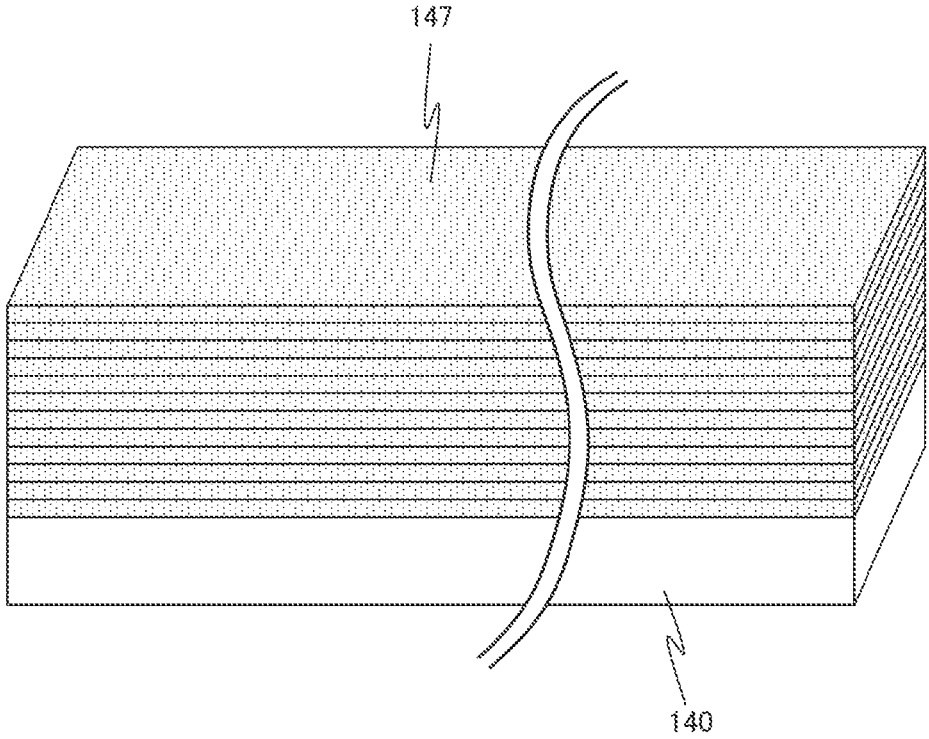
FIG. 3B is a perspective view showing a state after the piezoelectric sheets and the electroconductive sheets are stacked on the piezo-mounting plate to produce the laminate.
Figure 4A:
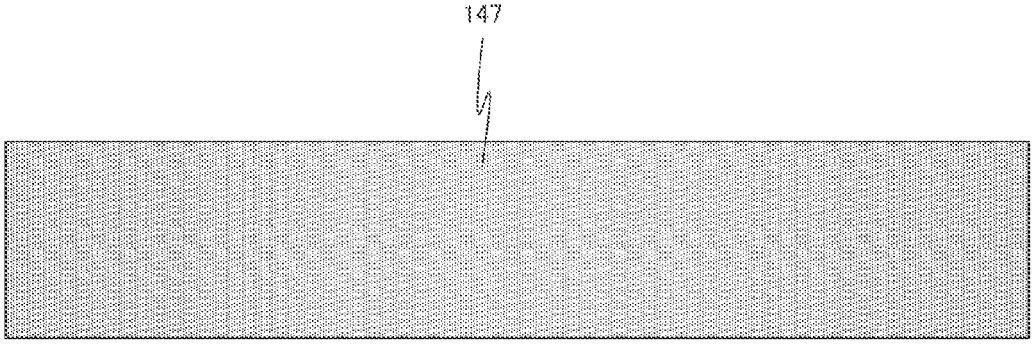
FIG. 4A is a plan view of the laminate illustrated in FIG. 3B.
Figure 4B:
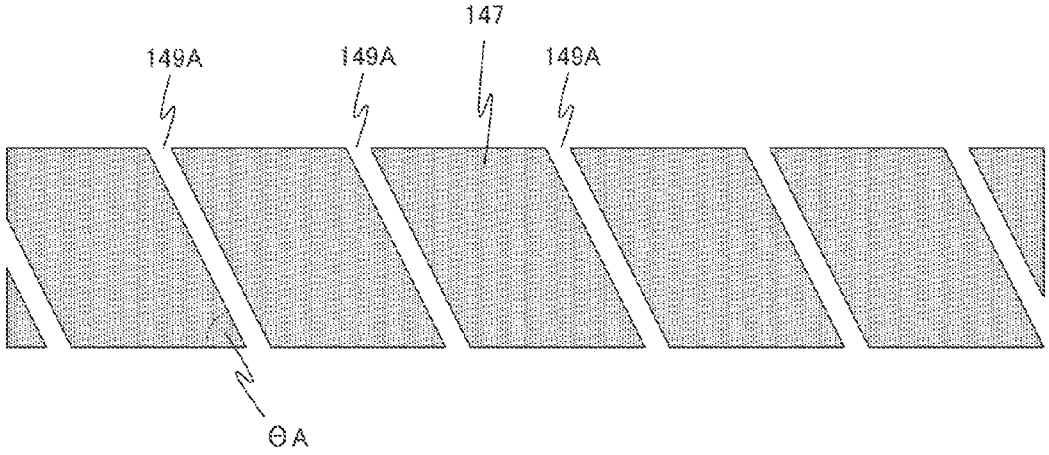
FIG. 4B is a plan view of the laminate provided with grooves inclined to the long side of a bottom surface of the laminate.

The method of providing the piezo-mounting plate to which the multilayer piezoelectric elements and the columns are fixed includes A) step A of stacking a plurality of piezoelectric sheets and a plurality of electroconductive sheets on the piezo-mounting plate to produce a laminate (FIGS. 3A and 3B) and B) step B of dividing the laminate to form the multilayer piezoelectric elements and the columns (FIGS. 4A and 4B).

A) FIGS. 3A and 3B show the step A. As illustrated in FIGS. 3A and 3B, in step A, a plurality of piezoelectric sheets (for example, a lead zirconium titanate (PZT) sheet) 145 and a plurality of electroconductive sheets 146 are stacked on piezo-mounting plate 140 (see, FIG. 3A) to produce laminate 147 (see, FIG. 3B). Stacked piezoelectric sheets 145 and stacked electroconductive sheets 146 are subjected to adhesion treatment and firing treatment, whereby piezoelectric sheets 145 and electroconductive sheets 146 are integrated to form laminate 147 having a rectangular solid shape.

Figure 4C:
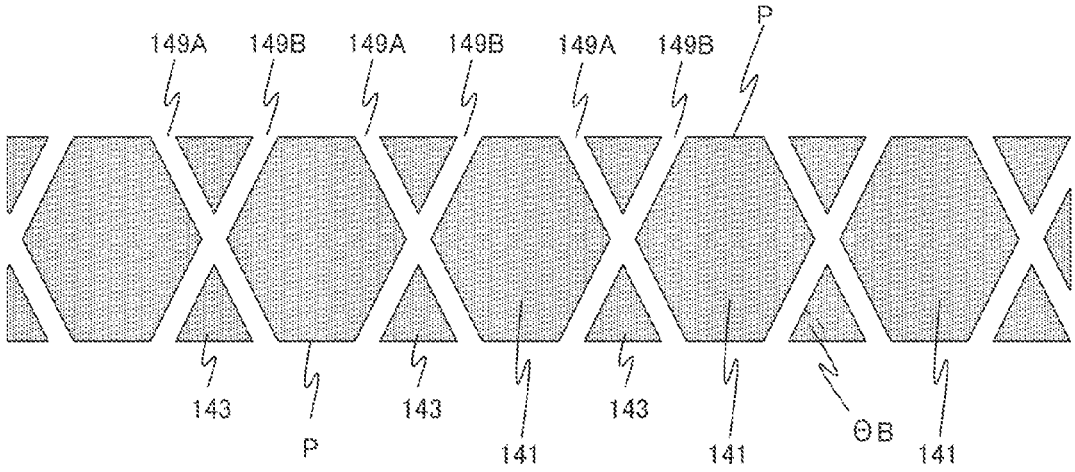
FIG. 4C is a plan view of the laminate provided with grooves inclined in the opposite direction to the long side of the bottom surface of the laminate.

B) FIGS. 4A to 4C show the step B. FIG. 4A is a plan view of laminate 147 illustrated in FIG. 3B. As illustrated in FIGS. 4A to 4C, in step B, laminate 147 is divided to form piezoelectric elements 141 and columns 143. The present invention can have a feature in the method of dividing laminate 147 in step B.

Step B further has a step of providing grooves 149A in laminate 147 at a predetermined pitch (FIG. 4B), grooves 149A being inclined to the long side of a bottom surface of laminate 147; and has a step of providing grooves 149B in laminate 147 at a predetermined pitch (FIG. 4C), grooves 149B being inclined in the opposite direction to grooves 149A to the long side of the bottom surface of laminate 147. The pitch of provision of grooves 149A and grooves 149B is the same as the arrangement pitch of the multilayer piezoelectric elements.

Grooves 149A and 149B are provided by carving laminate 147 with a dicing apparatus with a rotating blade, for example. The width of grooves 149A and 149B formed thus is usually 20 to 40 μm.

An inclination angle θA of groove 149A to the long side of the bottom surface of laminate 147 and an inclination angle θB of groove 149B to the long side of the bottom surface of laminate 147 are the same as each other, and it is preferably 30 to 60°.

As illustrated in FIG. 4C, groove 149A and groove 149B intersect with each other. As a result, hexagonal columnar multilayer piezoelectric elements 141 and triangular prism shaped columns 143 are formed. Surface P of multilayer piezoelectric element 141 is connected to an electrode for applying a voltage to the multilayer piezoelectric element. Meanwhile, the triangular prism shaped column is not connected to an electrode. By this constitution, multilayer piezoelectric element 141 functions as an actuator which vibrates the diaphragm, and column 143 functions as a member which fixes the diaphragm.

As described above, in the present invention, since multilayer piezoelectric element 141 and triangular prism shaped column 143 can be formed simultaneously, the processes is simplified, and the process yield is high.

2) In the second step, the diaphragm is stacked on the multilayer piezoelectric elements and the columns fixed to the piezo-mounting plate. It is preferable that the diaphragm is adhered to both of the multilayer piezoelectric elements and the columns.

3) In the third step, the partition walls and the nozzle plate are stacked on the diaphragm, whereby the ink chamber having the bottom surface, the side surface, and the upper surface is constituted.

The diaphragm and the partition walls as well as the partition walls and the nozzle plate may be bonded together with an adhesive or by welding; or they may be bonded by thermal diffusion bonding (thermocompression bonding).

3. Ink-jet Apparatus

Te ink-jet apparatus of the present invention has a feature of comprising the above ink-jet head, and also the ink-jet apparatus may have any members of a well-known ink-jet apparatus in addition to the above ink-jet head. For example, the ink-jet apparatus of the present invention has a member for fixing the ink-jet head and a stage for moving an object placed thereon, the object is to be applied with ink.

When the ink-jet head has the ink discharge channel, the ink-jet apparatus may comprise an ink circulation device. A driving pressure is applied to ink with the ink circulation device, whereby the ink is circulated. Although a pump may be used to apply the driving pressure to the ink, it is preferable to use a regulator which supplies a pressure by utilizing compressed air. This is because the driving pressure is made constant by using the regulator, so that the circulation speed of the ink is stabilized.

In the ink-jet apparatus, the ink in the ink-jet head may be constantly or intermittently circulated during operation of the ink-jet apparatus.

Hereinafter, although embodiments according to the present invention will be described with reference to the drawings, the present invention is not limited to the embodiments.

(Embodiment 1)

Figure 5:
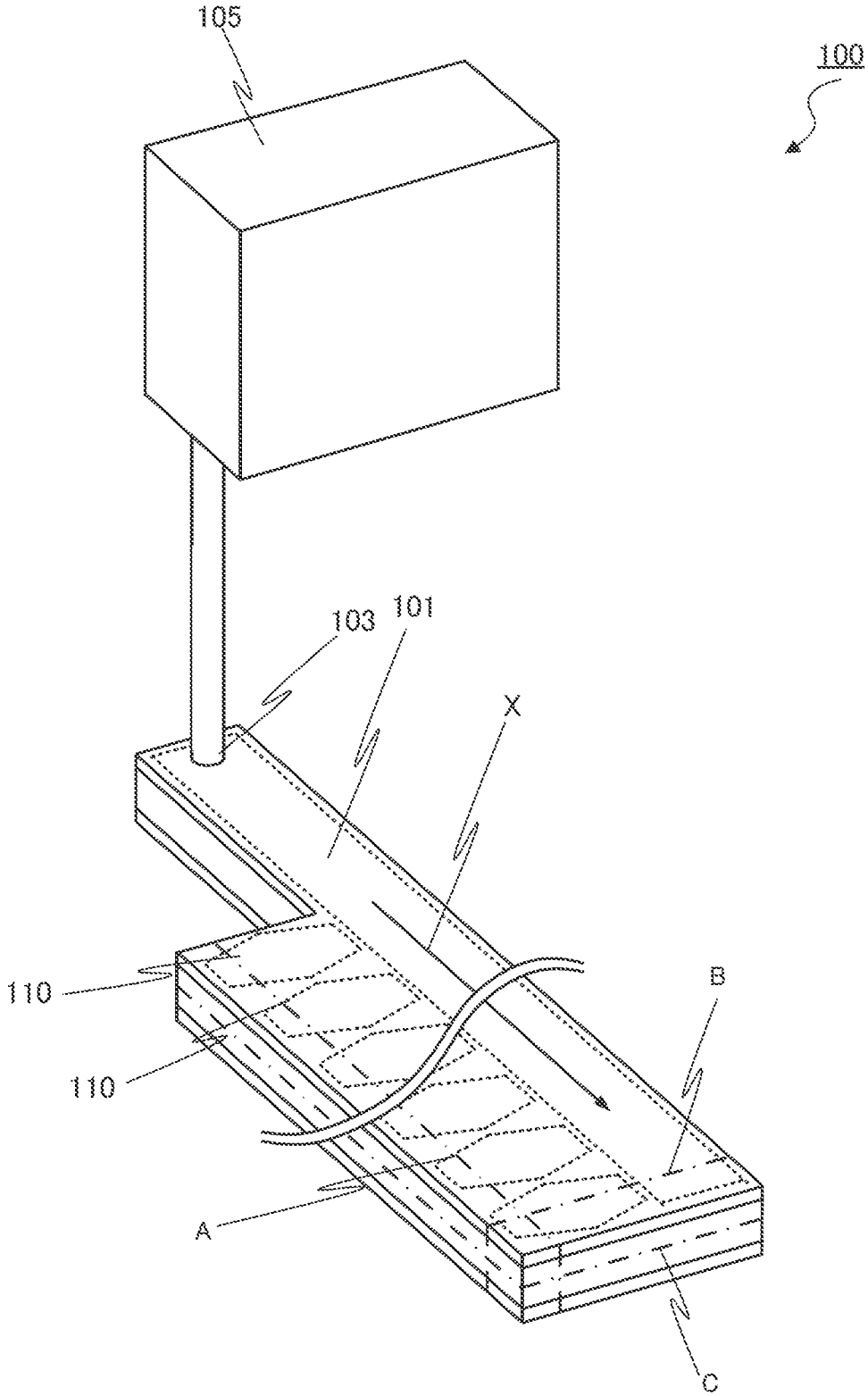
FIG. 5 is a perspective view of an ink-jet head of Embodiment 1.

FIG. 5 is a perspective view of ink-jet head 100 of Embodiment 1 according to the present invention. As illustrated in FIG. 5, ink-jet head 100 has ink supply channel 101 and a plurality of ink chambers 110 aligned along an ink flow direction X. Ink supply channel 101 is connected to ink tank 105 through ink feed port 103.

Figure 6A:
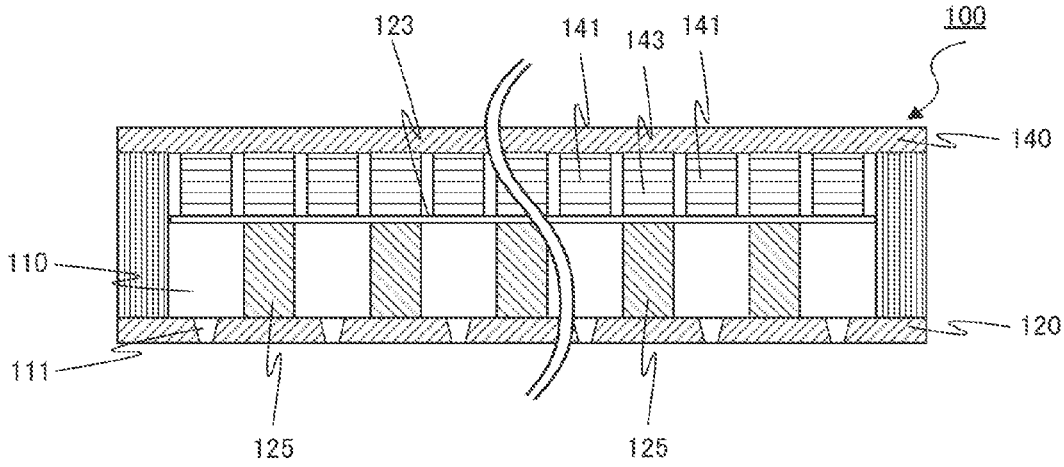
FIG. 6A is a cross-sectional view along an line A of the ink-jet head illustrated in FIG. 5.
Figure 6B:
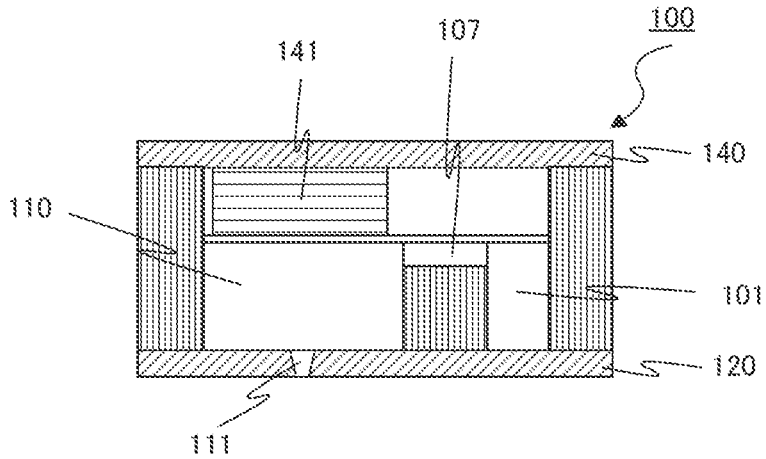
FIG. 6B is a cross-sectional view along a line B of the ink-jet head illustrated in FIG. 5.

FIG. 6A is a cross-sectional view along an line A of ink-jet head 100 illustrated in FIG. 5. FIG. 6B is a cross-sectional view along a line B of ink-jet head 100 illustrated in FIG. 5. FIG. 6C is a cross-sectional view along a line C of ink-jet head 100 illustrated in FIG. 5.

Figure 6C:
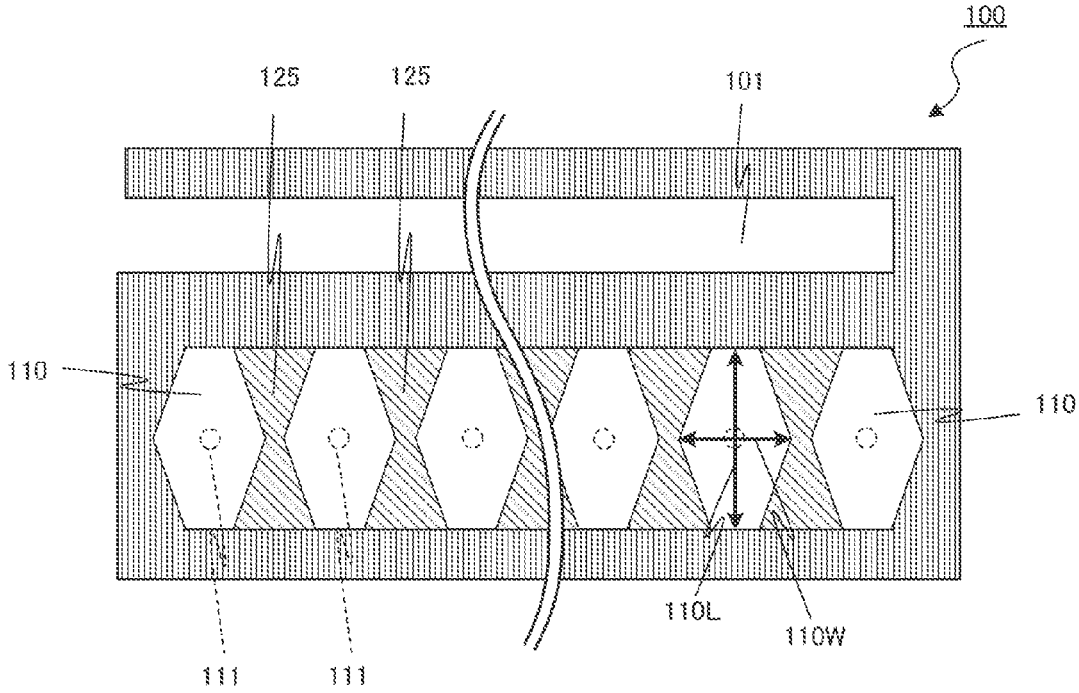
FIG. 6C is a cross-sectional view along a line C of the ink-jet head illustrated in FIG. 5.

As illustrated in FIGS. 6A to 6C, each ink chamber 110 has nozzle 111. Ink chamber 110 stores ink to be ejected through nozzle 111. As illustrated in FIG. 6B, ink chamber 110 communicates with ink supply channel 101 through ink communicating hole 107.

The bottom surface of ink chamber 110 is constituted of nozzle plate 120, the upper surface of ink chamber 110 is constituted of diaphragm 123, and the side surface of ink chamber 110 is constituted of partition walls 125. A plurality of ink chambers 110 shares the single nozzle plate 120 and the single diaphragm 123. Diaphragm 123 is fixed by being held between partition walls 125 and columns 143. Partition walls 125 and columns 143 holding diaphragm 123 therebetween overlap in plan view in at least a part thereof.

As illustrated in FIG. 6C, the upper and bottom surfaces of ink chamber 110 have a hexagonal shape. That is, in the present embodiment, ink chamber 110 is a hexagonal columnar space. A length (perpendicular to the ink flow direction) 110L of ink chamber 110 is usually 500 to 1500 μm, and a width (length parallel to the ink flow direction) 110W of ink chamber 110 is usually 50 to 180 μm.

As illustrated in FIGS. 6A and 6B, piezo-mounting plate 140 to which multilayer piezoelectric elements 141 and columns 143 are fixed is arranged on diaphragm 123. Hereinafter, piezo-mounting plate 140 to which multilayer piezoelectric elements 141 and columns 143 are fixed will be described in detail.

Figure 7A:
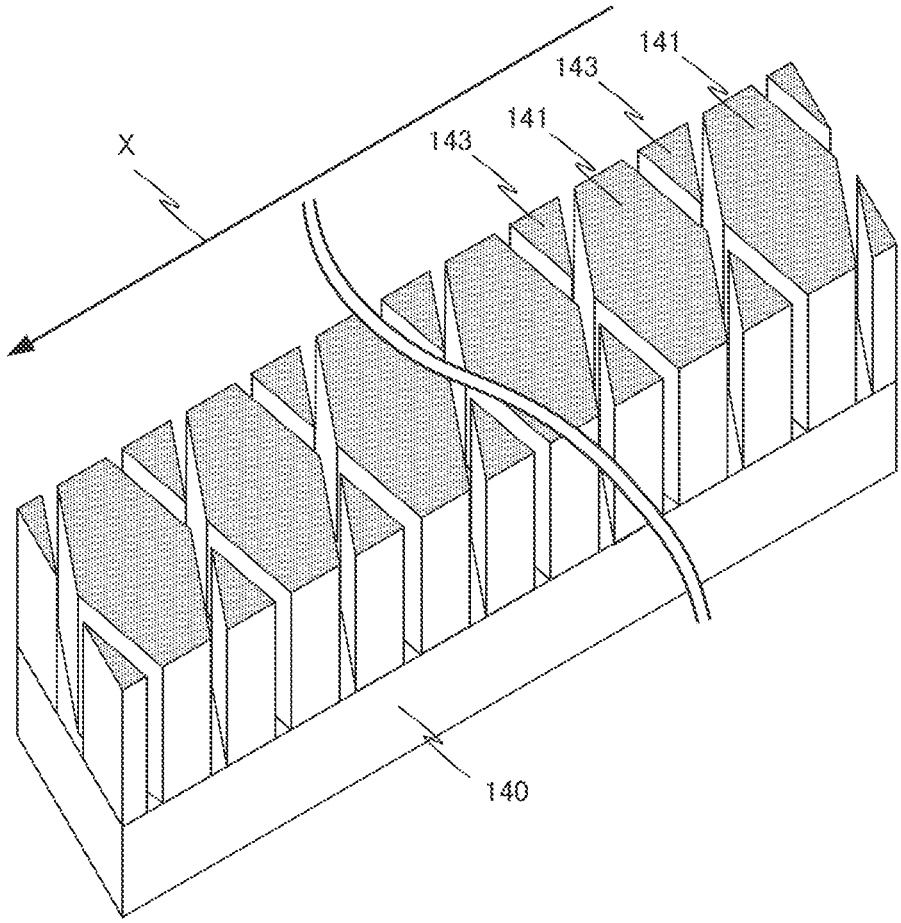
FIG. 7A is a perspective view of the piezo-mounting plate of the ink-jet head of Embodiment 1.
Figure 7B:
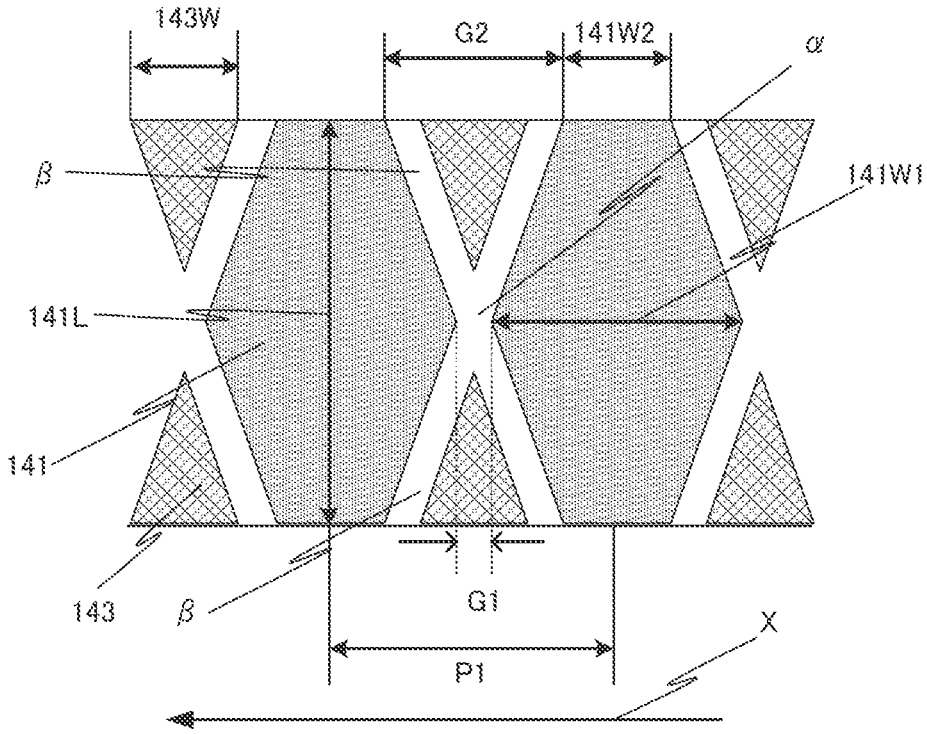
FIG. 7B is a partially enlarged plan view of the piezo-mounting plate illustrated in FIG. 7A.

FIG. 7A is a perspective view of piezo-mounting plate 140 to which multilayer piezoelectric elements 141 and columns 143 are fixed. FIG. 7B is a partially enlarged plan view of piezo-mounting plate 140 to which multilayer piezoelectric elements 141 and columns 143 are fixed.

As illustrated in FIG. 7A, hexagonal columnar multilayer piezoelectric elements 141 arranged in a row along the direction X and triangular prism shaped columns 143 arranged between multilayer piezoelectric elements 141 are fixed to piezo-mounting plate 140.

A length (perpendicular to the alignment direction (ink flow direction) X) 141L of a moving surface of multilayer piezoelectric element 141 is 300 to 800 μm. The largest width 141W1 of the width of the moving surface of multilayer piezoelectric element 141 (length in the alignment direction X) is 80 to 180 μm, and the smallest width 141W2 is 30 to 100 μm. A width (length in the alignment direction X) 143W of column 143 is 30 to 100 μm (see, FIG. 7B).

As illustrated in FIG. 7B, both of a portion α with a small gap and a portion β with a large gap are arranged between the adjacent multilayer piezoelectric elements 141. A length of the smallest gap G1 of the adjacent multilayer piezoelectric elements 141 is preferably 20 to 50 μm. A length of the largest gap G2 is preferably 50 to 140 μm.

Column 143 is arranged at only the portion β with a large gap and is not arranged at the portion α with a small gap. Both of the portion α with a small gap and the portion β with a large gap are provided between the adjacent multilayer piezoelectric elements 141, and column 143 is arranged at only the portion β with a large gap, whereby the area of the gap between multilayer piezoelectric elements 141 can be reduced (see, FIG. 2B). Consequently, both of "short pitch of the multilayer piezoelectric elements" and "increased area of the moving surface of the multilayer piezoelectric element" can be realized simultaneously (see, FIG. 2B).

Next, the operation of ink-jet head 100 of Embodiment 1 will be described.

First, ink is supplied to ink supply channel 101 from ink tank 105. The ink supplied to ink supply channel 101 passes through ink communicating hole 107 to be supplied into each ink chamber 110 (see, FIG. 6B).

Next, a driving voltage is applied to piezoelectric element 141, whereby the moving surface of multilayer piezoelectric element 141 vibrates diaphragm 123 constituting the upper surface of ink chamber 110. Consequently, the ink in ink chamber 110 is pressurized. As a result, the ink is ejected through nozzle 111.

As described above, in the present embodiment, the area of the moving surface of multilayer piezoelectric element 141 is relatively large. Thus, in ink-jet head 100 of the present embodiment, the ink in the ink chamber can be pressurized by a large force, and thus even high viscosity ink can be ejected.

In ink-jet head 100 of the present embodiment, since diaphragm 123 is fixed by being held between columns 143 and partition walls 125 arranged between ink chambers 110, the vibration of one ink chamber 110 can be prevented from transmitting to the other ink chambers 110 (crosstalk).

(Embodiment 2)

In Embodiment 2, an ink-jet head having an ink discharge channel will be described.

FIG. 8 is a perspective view of ink-jet head 200 of Embodiment 2. Ink-jet head 200 of Embodiment 2 has the same basic structure as ink-jet head 100 of Embodiment 1 except for having ink discharge channel 102. The same components as those of ink-jet head 100 of Embodiment 1 are assigned the same reference numerals, and the description thereof will not be repeated here.

As illustrated in FIG. 8, ink-jet head 200 has ink discharge channel 102. Ink discharge channel 102 communicates with each ink chamber 110. Ink discharge channel 102 has ink discharge port 104.

Figure 9A:
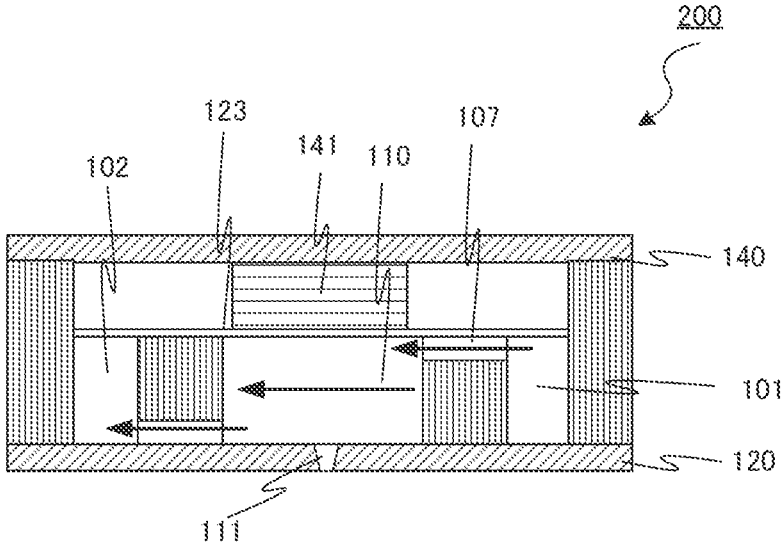
FIG. 9A is a cross-sectional view along an line A of the ink-jet head illustrated in FIG. 8.
Figure 9B:
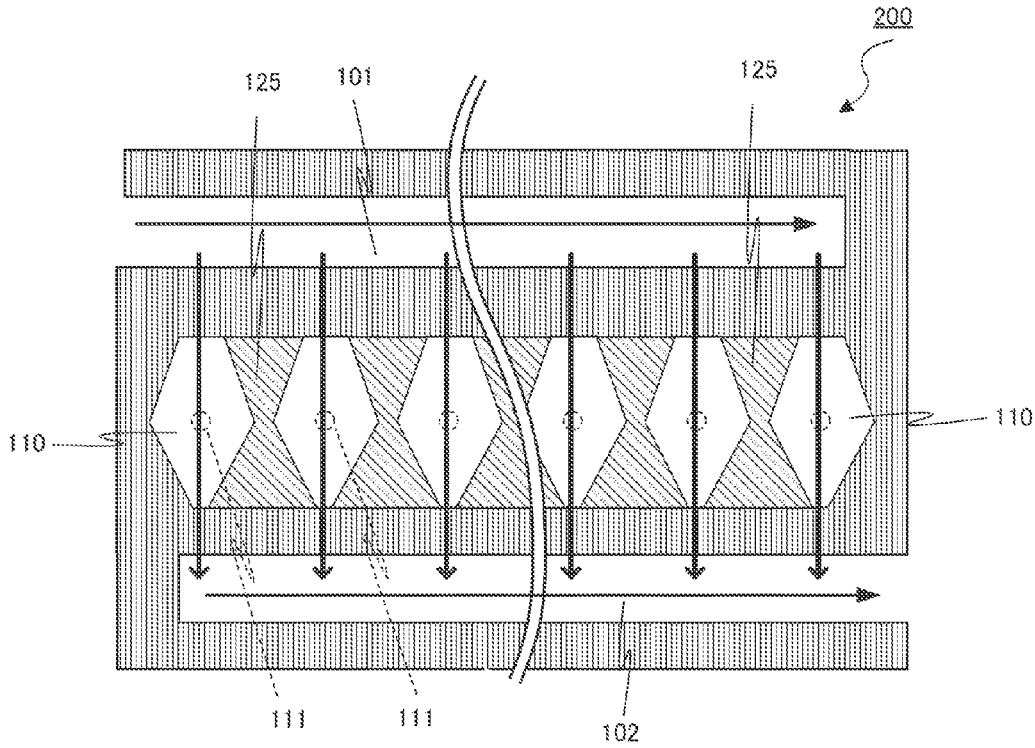
FIG. 9B is a cross-sectional view along a line B of the ink-jet head illustrated in FIG. 8.

FIG. 9A is a cross-sectional view along an line A of ink-jet head 200 illustrated in FIG. 8. FIG. 9B is a cross-sectional view along a line B of ink-jet head 200 illustrated in FIG. 8. The arrows in FIGS. 9A and 9B indicate a direction that ink flows in ink-jet head 200.

As illustrated in FIGS. 9A and 9B, by virtue of the provision of ink discharge channel 102 in ink-jet head 200, ink can flow to ink discharge channel 102 from ink supply channel 101 via the inside of ink chamber 110, and therefore the ink can be circulated in ink chamber 110. Consequently, ink stagnation and air inclusion in ink chamber 110 can be prevented, and the ink can be ejected stably.

In the present embodiment, as illustrated in FIG. 9B, it is preferable that ink chamber 110 is narrowed toward ink discharge channel 102.

When the ink-jet head has ink discharge channel 102, as illustrated in FIG. 9B, in ink chamber 110, the ink flows from ink supply channel 101 toward ink discharge channel 102. Therefore, a pressure for ejecting ink through the nozzle, which is generated by multilayer piezoelectric element 141, may leak toward ink discharge channel 102 with the ink flow force.

However, as in the present embodiment, when ink chamber 110 is narrowed toward ink discharge channel 102, the force generated by multilayer piezoelectric element 141 is hard to leak toward ink discharge channel 102. Accordingly, the force generated by multilayer piezoelectric element 141 can be efficiently converted into the ink ejection force, and attenuation of the ejection force can be prevented.

INDUSTRIAL APPLICABILITY

The ink-jet head of present invention has high resolution and a large ejection force. Thus, for example, the ink-jet head of the present invention is suitably used as an ink-jet head for applying organic luminescent materials upon manufacturing of an electronic device such as an organic EL display panel.

REFERENCE SIGNS LIST

100, 200 Ink-jet head
101 Ink supply channel
102 Ink discharge channel
103 Ink feed port
104 Ink discharge port
105 Ink tank
107 Ink communicating hole
110 Ink chamber
111 Nozzle
120 Nozzle plate
123 Vibrating plate (diaphragm)
125 Partition wall
140 Piezo-mounting plate
141 Multilayer piezoelectric element
143 Column
145 Piezoelectric sheet
146 Electroconductive sheet
147 Laminate
149 Groove

The invention claimed is:

1. An inkjet head comprising:

an ink supply channel configured to allow ink supplied from outside to flow;

two or more ink chambers each having a bottom surface with a nozzle for ejecting the ink and an upper surface constituting a vibrating plate, the two or more ink chambers being arranged in a row along a direction in which the ink flows in the ink supply channel;

one or more partition walls each partitioning the ink chambers; and a piezo-mounting plate arranged on the upper surface of the ink chambers, the piezo-mounting plate having two or more multilayer piezoelectric elements and two or more columns fixed thereto, the two or more multilayer piezoelectric elements being arranged in a row, and the two or more columns being arranged between the multilayer piezoelectric elements adjacent to each other, the two or more multilayer piezoelectric elements can vibrate the respective upper surfaces of the two or more ink chambers, wherein each of the partition walls and each of the columns are directly opposite each other across the vibrating plate, a large gap and a small gap are arranged between the two multilayer piezoelectric elements adjacent to each other, and a large gap and a small gap are arranged between the two ink chambers adjacent to each other.

2. The ink jet head according to claim 1, wherein the maximum value of a gap between the multilayer piezoelectric elements is 50 to 140 μm.

3. The ink jet head according to claim 1, wherein each of the multilayer piezoelectric elements has a hexagonal columnar shape, a bottom surface of each of the multilayer piezoelectric elements having the hexagonal columnar shape has sides a and b facing each other and being parallel to a direction in which the multilayer piezoelectric elements are aligned, the side a of each of the multilayer piezoelectric elements is aligned along a straight line, and the side b of each of the multilayer piezoelectric elements is aligned along a straight line.

4. The ink jet head according to claim 3, wherein the upper surface and the bottom surface of each of the ink chambers have a hexagonal shape.

5. The ink jet head according to claim 1, further comprising an ink discharge channel communicating with the two or more ink chambers, and the ink discharge channel being configured to allow the ink discharged from the ink chamber to flow.

6. An ink jet apparatus comprising the ink jet head according to claim 1.

7. A method of manufacturing the ink jet head according to claim 1, comprising providing the piezo-mounting plate having the multilayer piezoelectric elements and the columns fixed thereto, stacking the vibrating plate on the multilayer piezoelectric elements and the columns, and stacking the partition walls and a nozzle plate on the vibrating plate, wherein:

the step of providing the piezo-mounting plate comprises the steps of:

providing the piezo-mounting plate;

stacking a piezoelectric sheet and an electroconductive sheet on the piezo-mounting plate to form a laminate having a rectangular solid shape;

providing two or more grooves A in the laminate at a constant pitch, the two or more grooves A being inclined to the long side of a bottom surface of the laminate having the rectangular solid shape; and providing two or more grooves B in the laminate at a constant pitch, the two or more grooves B being inclined in the opposite direction to the grooves A with respect to the long side of the bottom surface of the laminate having the rectangular solid shape and intersecting with the grooves A, to form the multilayer piezoelectric elements and the columns.

* * * * *